United States Patent [19]

Ackeret

[11] Patent Number: 4,691,456

[45] Date of Patent: Sep. 8, 1987

[54] CONTAINER FOR STORING A STACK OF PICTURES

[75] Inventor: Peter Ackeret, Küsnacht, Switzerland

[73] Assignee: Licinvest AG, Chur, Switzerland

[21] Appl. No.: 537,861

[22] Filed: Sep. 30, 1983

[30] Foreign Application Priority Data

Oct. 4, 1982 [DE] Fed. Rep. of Germany ..... 3236643

[51] Int. Cl.[4] ..... G09F 3/18

[52] U.S. Cl. ..... 40/10 R; 40/152.1; 40/490; 40/489; 40/492; 206/45.31

[58] Field of Search ..... 40/10 R, 490, 152, 152.1, 40/363, 154, 492, 530, 489; 206/45.31, 44 B

[56] References Cited

U.S. PATENT DOCUMENTS

| | | | |
|---|---|---|---|
| 11,758 | 10/1854 | Peck | 40/154 |
| 211,462 | 1/1879 | Dole | 206/45.31 |
| 214,105 | 4/1879 | Cole | 40/152.1 |
| 348,611 | 9/1886 | Beatty | 40/152.1 |
| 836,418 | 11/1906 | Voege | 40/530 |
| 910,576 | 1/1909 | Randall | 40/158 R |
| 1,544,214 | 6/1925 | Bruns | 40/152.1 |
| 1,544,463 | 6/1925 | Lengsfield | 206/45.31 |
| 1,658,234 | 2/1928 | Field | 206/45.31 |
| 1,693,622 | 12/1928 | Spaulding | 206/45.19 |
| 1,844,189 | 2/1932 | Stuart | 206/45.31 |
| 1,940,328 | 12/1933 | Schrotenboer | 40/152 |
| 1,945,792 | 2/1934 | Stephens | 206/45.31 |
| 2,642,876 | 6/1953 | Heilly | 206/44 B |
| 2,919,509 | 1/1960 | Strandberg | 40/489 |
| 3,015,179 | 1/1962 | Muller | 40/152.1 |
| 3,061,961 | 11/1962 | Cohen | 40/363 |
| 3,343,659 | 9/1967 | Marondel | 206/45.31 |
| 3,377,727 | 4/1968 | Weggeland | 40/79 |
| 3,423,005 | 1/1969 | Ceibson et al. | 206/45.31 |
| 3,684,084 | 8/1972 | Kanzelberger | 206/45.31 |
| 4,057,920 | 11/1977 | Weggeland | 40/79 |
| 4,173,838 | 11/1979 | Antos | 40/366 |
| 4,238,899 | 12/1980 | Ackeret | 40/513 |
| 4,241,528 | 12/1980 | Ackeret | 40/490 |
| 4,241,529 | 12/1980 | Baur | 40/490 |
| 4,242,820 | 1/1981 | Ackeret | 40/490 |
| 4,245,417 | 1/1981 | Ackeret | 40/513 |
| 4,259,802 | 4/1981 | Ackeret | 40/513 |
| 4,305,498 | 12/1981 | Paytas | 206/44 B |
| 4,413,435 | 11/1983 | Baur | 40/489 |
| 4,458,434 | 7/1984 | Ackeret | 40/513 |

FOREIGN PATENT DOCUMENTS

| | | | |
|---|---|---|---|
| 1772198 | 1/1971 | Fed. Rep. of Germany . | |
| 2212135 | 11/1972 | Fed. Rep. of Germany . | |
| 2742345 | 3/1979 | Fed. Rep. of Germany . | |
| 305914 | 2/1929 | United Kingdom | 40/152 |

*Primary Examiner*—Gene Mancene
*Assistant Examiner*—J. Hakomaki
*Attorney, Agent, or Firm*—Robert R. Jackson; Jeffrey H. Ingerman

[57] ABSTRACT

A container for accommodating a stack of pictures is disclosed. The container has a display window, a first chamber for accommodating a single picture at the window, and a second chamber separated from the first chamber wherein the remaining pictures of the stack can be loosely housed.

14 Claims, 17 Drawing Figures

Fig. 2
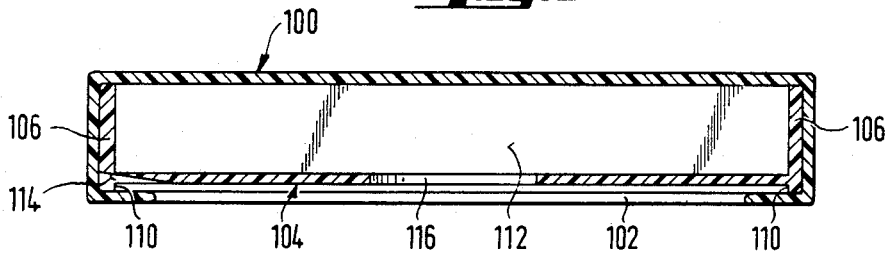
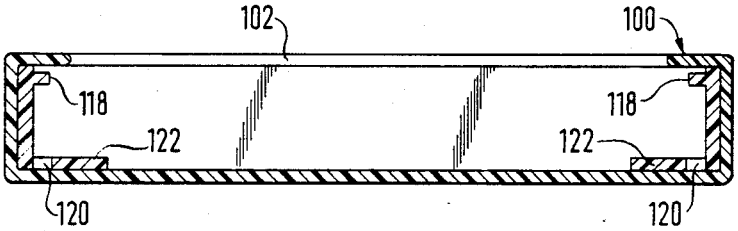
Fig. 3
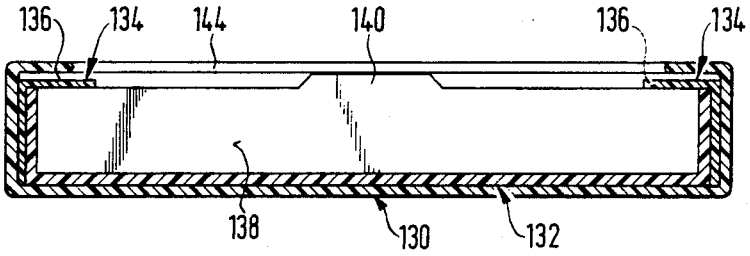
Fig. 4

CONTAINER FOR STORING A STACK OF PICTURES

BACKGROUND OF THE INVENTION

The invention relates to containers for storing stacks of pictures, and relates particularly to containers of a type having a display window at which a single picture can be presented. A container of this general type is described in my U.S. Pat. No. 4,242,820, issued Jan. 6, 1981.

One known type of container for storing pictures is a twin-container wherein a common housing symmetrically holds two identical drawers which, independently of each other, can each house a stack of pictures, the uppermost picture of each stack being presented at a respective display window. Each stack has a respective elastic system to serve as a biasing device. When one drawer is withdrawn from its housing shelf, the biasing device for that drawer is deactivated without effecting the biasing device of the other drawer. A partition separates the two drawers.

The patent referred to above discloses a great number of further containers for pictures which can also be considered as twin or multiple containers. Several embodiments of containers disclosed in that patent have a biasing device, comprising a spring system for adapting the container to hold stacks comprising different numbers of pictures. Frequently, the outer container members, such as the housing, lid, and window, are made of plastic while the spring systems generally comprise metallic springs. As a matter of economics, these materials require different methods of manufacture. The spring systems must then be assembled with the plastic members in a separate manufacturing step. Such assembly is relatively expensive. Plastic materials of moderate cost have only limited resilience.

It is an object of the present invention to provide container for pictures that does not use spring systems for biasing devices.

SUMMARY OF THE INVENTION

The container invention is a two-chambered container for a stack of pictures. One chamber displays a single picture while the other chamber stores one or more additional pictures. The stack need not comprise a fixed number of pictures or be of a fixed thickness. An element separating the two chambers also serves to hold the picture in the display chamber in position at a display window.

BRIEF DESCRIPTION OF THE FIGURES

FIGS. 2, 3 and 4, respectively, show sections through three alternate constructions of a container of the first embodiment taken from lines 2—2, 3—3 and 4—4 of FIG. 1.

DETAILED DESCRIPTION OF THE PREFERRED EMBODIMENTS

Figure 1:
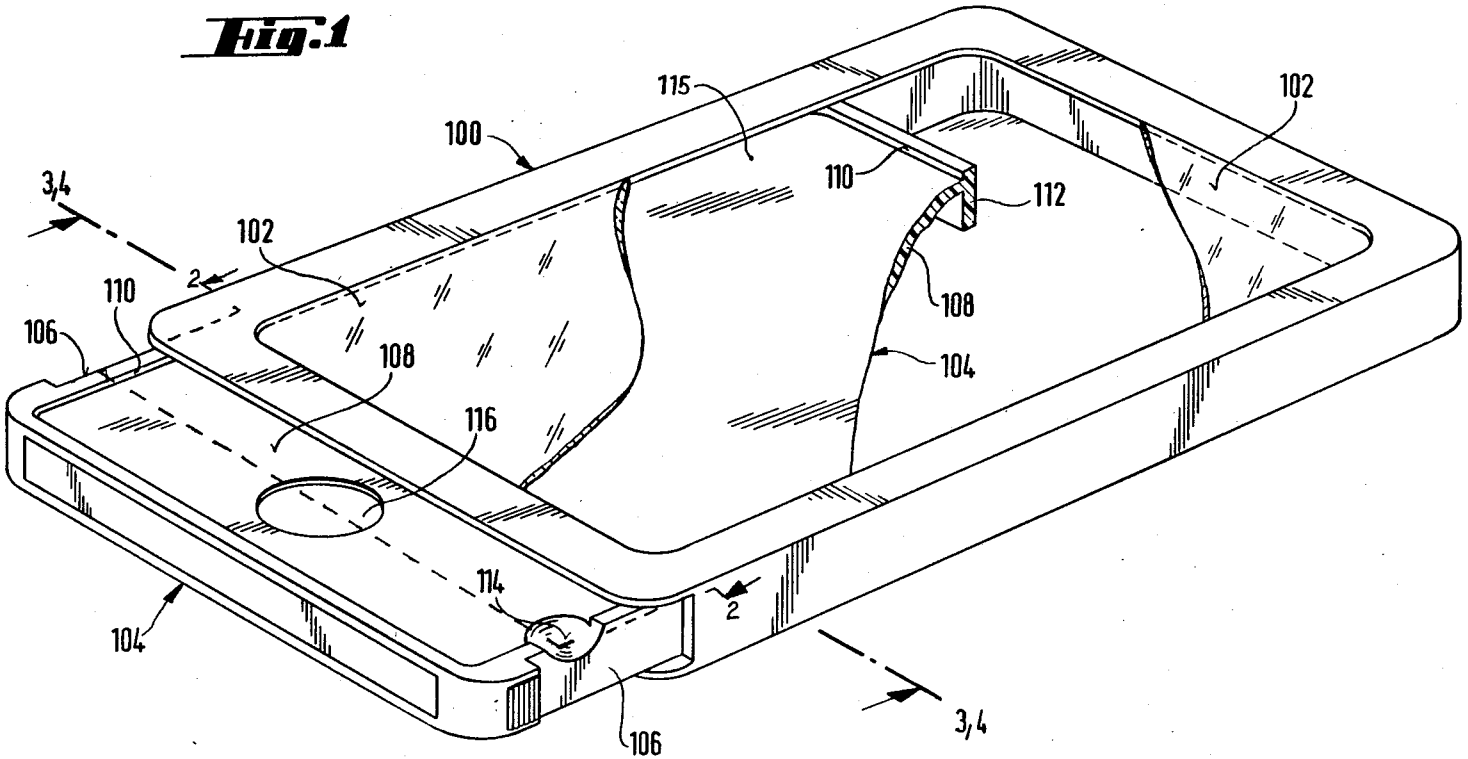
FIG. 1 is an isometric view, with some portions cut away for clarity, of a first preferred embodiment of the invention.

FIG. 1 shows a first embodiment, comprising a housing 100 made of, for example, opaque plastic material, having a transparent display window 102 on its upper side. A drawer 104 comprising a partition plate 108 and peripheral flanges or edges 110 and 112 is movable into and out of housing 100 which is open at one end for this purpose. The upper edge 110 extends from the periphery of plate 108 upwards, in the direction of the display window, and lower edge 112, which is less narrow than edge 110, extends downward toward the housing bottom 113. When the drawer 104 is in the housing 100, plate 108 is parallel to the plane of the display in window 102. The edges 110, 112 define the lateral walls 106 of the drawer 104 and cooperate with the housing lateral walls 107 to guide the drawer 104 for sliding movement within the housing 100. One end of the drawer 104 is slightly wider than the remainder of the drawer 104 and is roughened to facilitate gripping the drawer 104 to remove it from the housing 100.

As can be seen from FIG. 1, the upper edge 110, which extends toward the display window 102 when the drawer 104 is in place in the housing 100, defines a first, very shallow upper chamber 115 for accommodating a single picture which is to be presented flat at the window 102. Between the partition plate 108 and the housing bottom 113, the second edge 112 defines a second, deeper chamber 117 for a stack of pictures. If chamber 117 contains fewer pictures than its maximum capacity, these pictures are loose. However, in this embodiment (and all other embodiments of the invention discussed below), the fact that the pictures in the second chamber are loose is of no importance; what matters is that the one picture in the first chamber will always be held flat.

In order to remove the individual picture from the first chamber 115, the drawer 104 is withdrawn completely from the housing 100 and the picture is grasped at its edge where it is accessible because of an indentation 114 in edge 110 and plate 108. In order to remove the stack of pictures from the lower chamber 117, the container (after the flat upper chamber 115 has been emptied) is turned upside-down. The stack can be pushed with a finger tip through a hole 116 in partition plate 108 to a position where the edges of the pictures can be grasped. FIG. 2 illustrates (in section) this upside-down position of the container.

An alternative construction for the first embodiment, shown in FIG. 3, avoids the need to turn the container upside-down to remove the pictures. Instead of the partition plate 108, only lateral support rails 118 extending inward from lateral walls 106 are provided. The bottom of the drawer is defined by two lateral bars 122 parallel to but wider than rails 118. If the drawer is made by injection molding, openings 120 in bars 122 permit the removal of the drawer from the mold. The stack of pictures can be removed, as can easily be seen, by slightly bending the pictures to permit them to pass between the rails 118. A finger tip push from below will achieve this.

In another alternative construction, shown in FIG. 4, a separate third member 134 is inserted between housing 130 and drawer side walls 132. Member 134 has inwardly protruding wall portions or rails 136 separating the two chambers. Member 134 remains in housing 130 upon withdrawal of the drawer and therefore can be formed integrally with the housing 130. (However, integral formation would cause problems in manufacturing by injection molding and therefore, although within the scope of the invention, is not preferred.) When the drawer is pulled from the housing, the rear wall 138 of the drawer pushes out the stack of pictures beneath the rails 136 while a projection 140 on the top of drawer rear wall 138, extending between rails 136, similarly moves out a picture supported on rails 136 at display window 144.

Figure 5:
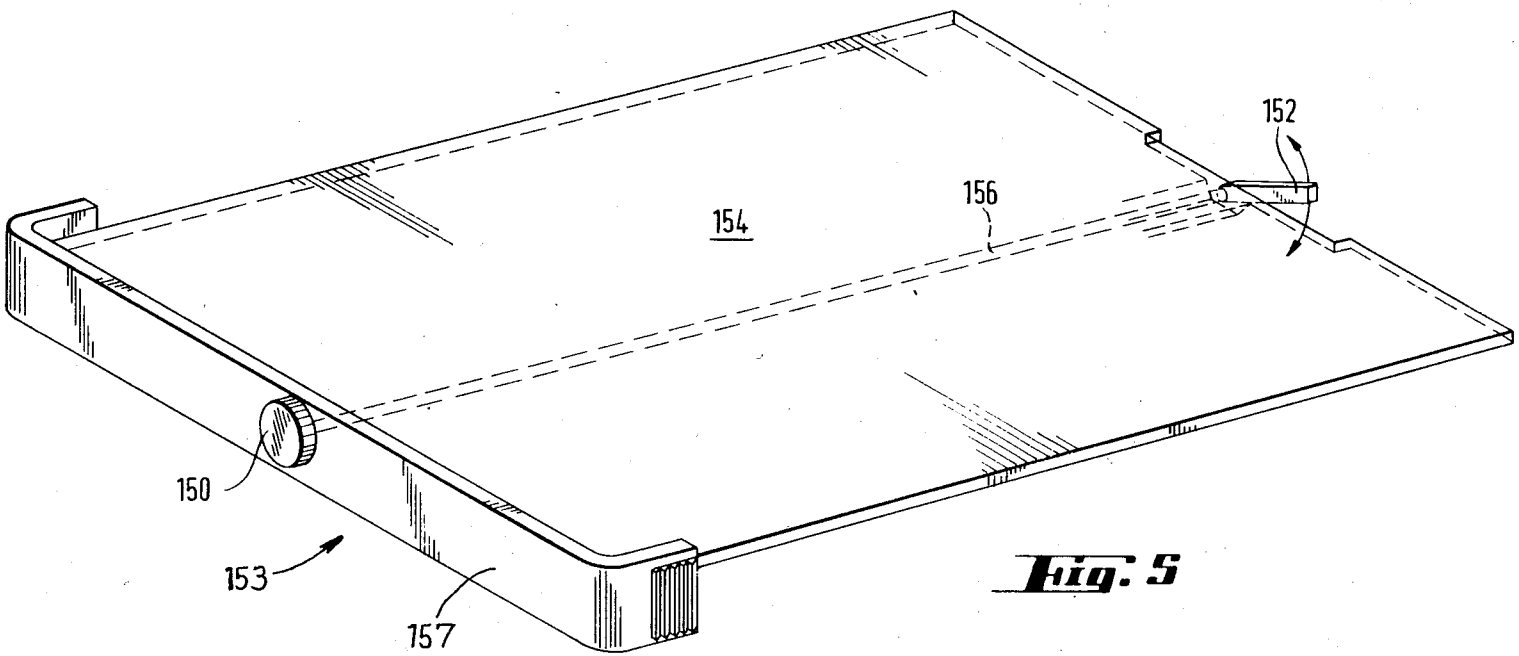
FIG. 5 is an isometric view of a fourth alternative construction of a drawer for a container of the type of FIG. 1.
Figure 6:
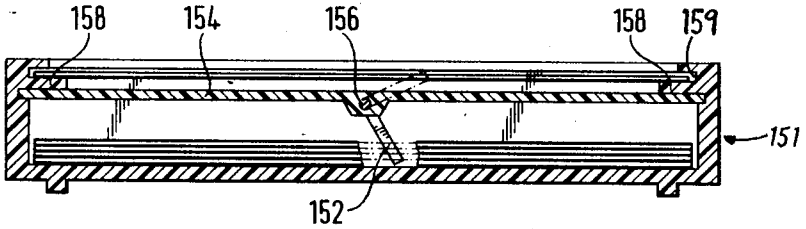
FIG. 6 is a view, analogous to that of FIGS. 3 and 4, of the construction shown in FIG. 5.

FIGS. 5 and 6 show still another alternative embodiment having a housing 151, and a drawer 153. The drawer 153 comprises a separating plate 154 with a switching shaft 156 extending therethrough, a front wall 157 which closes the open end of the housing, a switch button 150 at the front wall 157 for turning the shaft 156, and a driver element 152 movable via button 150 and shaft 156 between two different positions. When the drawer 153 is withdrawn from the housing 151, driver element 152, if above plate 154 as in FIG. 5, removes the individual picture from the upper chamber, or if below plate 154, removes the stack. Separating elements, such as lateral rails 158, are stationarily disposed in the housing to define the upper and lower chambers. The plate 154 is received in and guided along lateral slots 159 defined in the housing inner wall.

Figure 7:
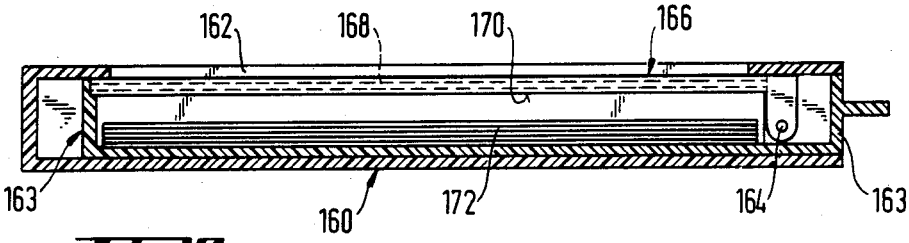
FIGS. 7 and 7*a* show a container of a second preferred embodiment closed and opened, respectively.
Figure 8:
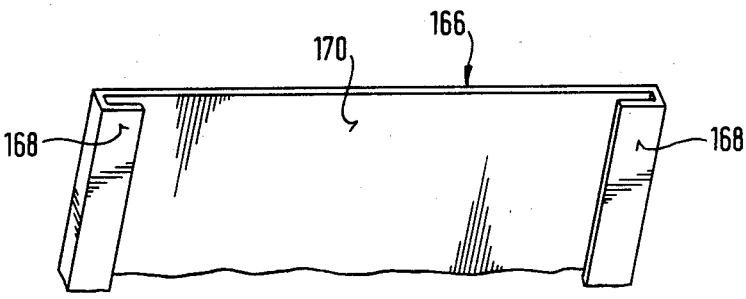
FIG. 8 is an isometric view of a portion of the free end of a display window member of the second embodiment.

In another preferred embodiment, shown in FIGS. 7, *7a* and 8, the container comprises a housing 160 and a drawer 163 which is slidably removable from the housing in a direction parallel to the display window 162 in the top of the housing 160. At the leading end of drawer 163, provided with a projecting handle, a generally planar picture holder 166 is connected to the drawer 163 by a pivot 164, about which picture holder 166 can be rotated relative to the main body of drawer 163 (FIG. *7a*). FIG. 8 illustrates the free or distal end of picture holder 166. Holder 166 has a transparent plate 170, through which the picture is viewed, and separating elements, such as lateral rails 168, which separate a picture disposed between plate 170 and the rails 168 from a stack of pictures 172 in the drawer, in such a manner that the separated picture is retained in place against plate 170.

In the position shown in FIG. *7a*, the drawer 163 has been withdrawn from the housing 160, the picture holder 166 pivoted up from the drawer, and the drawer reinserted into the housing. In that position, the container serves as a stand-up frame. If the display window 162 has a transparent pane, the pictures in the remainder of the stack 172 are protected against dust when the holder 166 is in the position shown in FIG. *7a*. The picture holder 166 can also be used in the inverse manner, i.e., with the rails 168 facing the window 162 when the container is closed (FIG. 7). In the closed position (FIG. 7), the upper chamber (between rails 168 and window 162) is then separated from the lower chamber (above the drawer bottom) by plate 170.

Figure 7A:
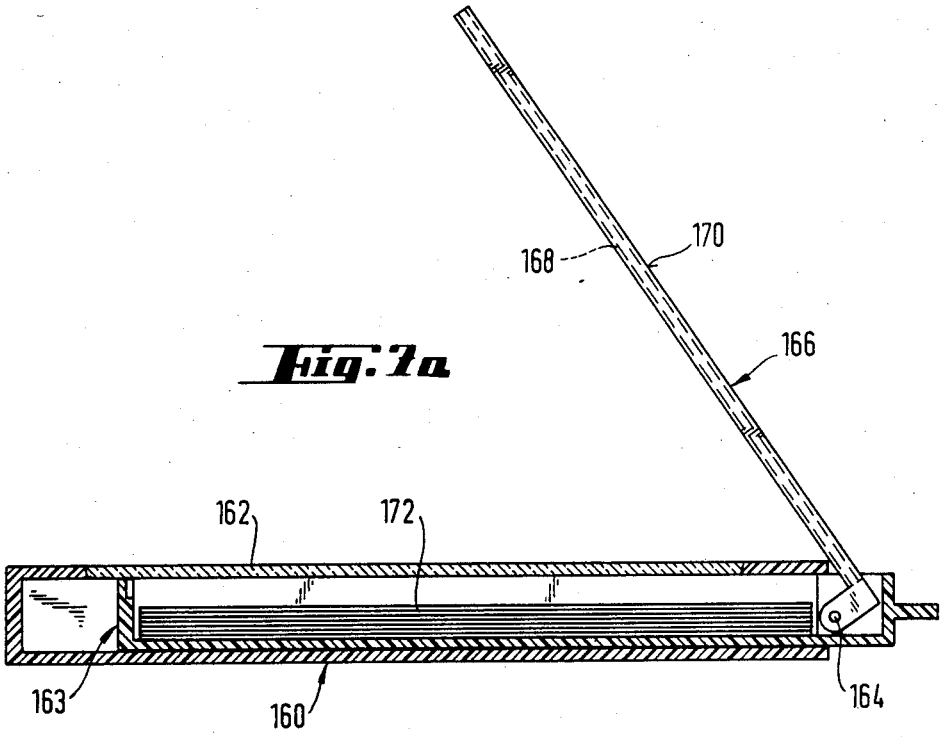
Figure 9:
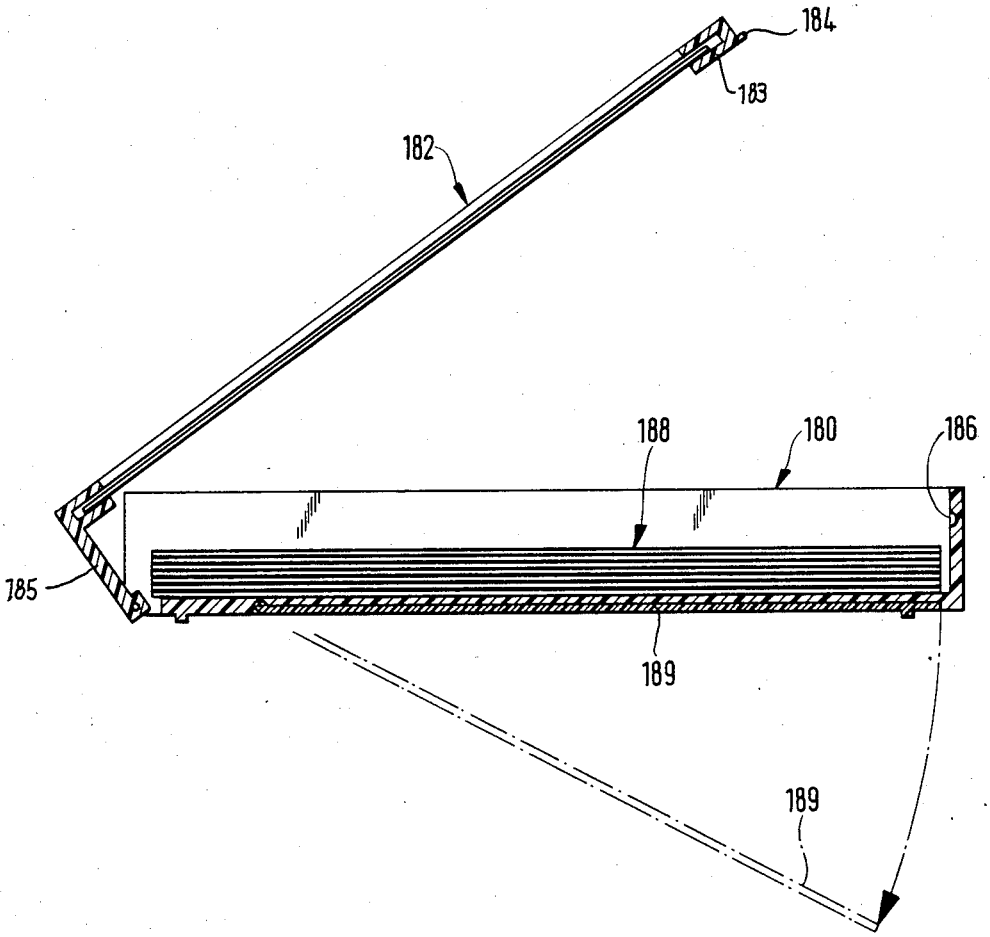
FIG. 9 is a side view of a third preferred embodiment.

A third preferred embodiment, shown in FIG. 9, is similar to that shown in FIGS. 7, *7a* and 8. The container comprises a housing 180 open at the top and at one end and a picture holder 182 having at one end a piece 185 perpendicular to the rest of holder 182. The end of piece 185 is pivotally connected to housing 180. Picture holder 182 closes off the open top and open end of housing 180 when the container is closed. Picture holder 182 has, at each end, lateral rails 183 below and spaced apart from the upper plate of picture holder 182. The rails 183 act as elements separating upper and lower picture chambers when the holder 182 is in the closed position. The picture holder's L-shape and pivotal connection to housing 180 at the free end of piece 185 facilitate removal of a stack 188 of pictures. As can be seen, the container itself cannot serve as a stand up frame, unlike the embodiment of FIG. 7A. Accordingly, to permit the container to be used as a stand-up frame, stand foot 189 is provided, stored in a recess in and pivotably connected to the outer face of the housing 180 opposite picture holder 182. Stand foot 189 is unfolded for use, as indicated in phantom. A tip 184 is provided at the far end of holder 182 to cooperate with an indentation 186 in one wall of housing 180 as a snap-lock device to lock the container closed.

Figure 10:
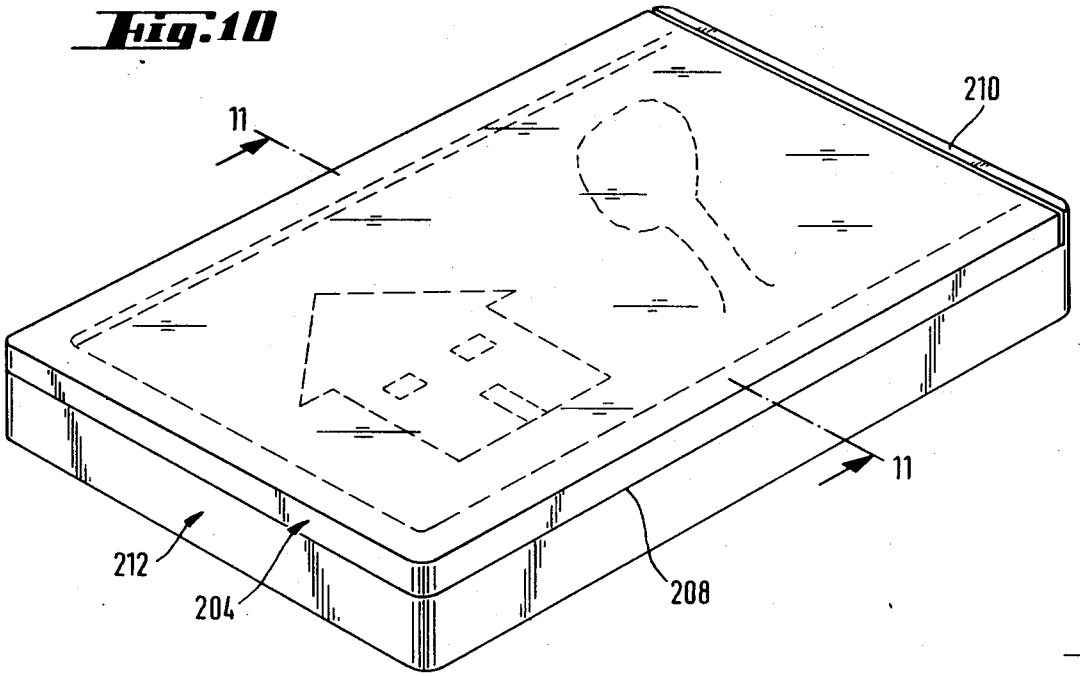
FIG. 10 is an isometric view of a fourth preferred embodiment.
Figure 11:
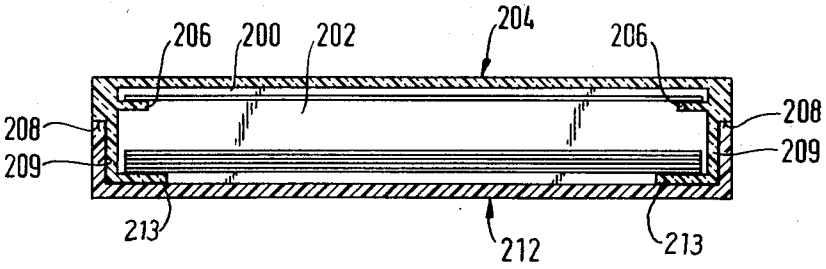
FIG. 11 is a sectional view of the fourth embodiment taken from line 11—11 of FIG. 10.

A fourth embodiment is shown in FIGS. 10 and 11. A shallow upper chamber 200 and a deeper lower chamber 202 are defined in a first member 204 by symmetric rails 206 integral with member 204. A lower edge or wall 209, stepped inward at 208 from the perimeter of member 204, extends around three narrow sides of member 204. The edge or wall 209 has an inward-pointing ledge or shelf 213 at its bottom to receive a stack of pictures. The first member 204 fits into a second member 212, which has the shape of an upwardly open box mating into the step 208 of edge 209 and closes the lower chamber 202. The fourth side of both chambers is covered by an upstanding wall 210 of the second member 212. The outer faces of members 204 and 212 are flush, forming a straight side edge (FIG. 11). Members 204 and 212 are connected frictionally and are snapped together.

Figure 12:
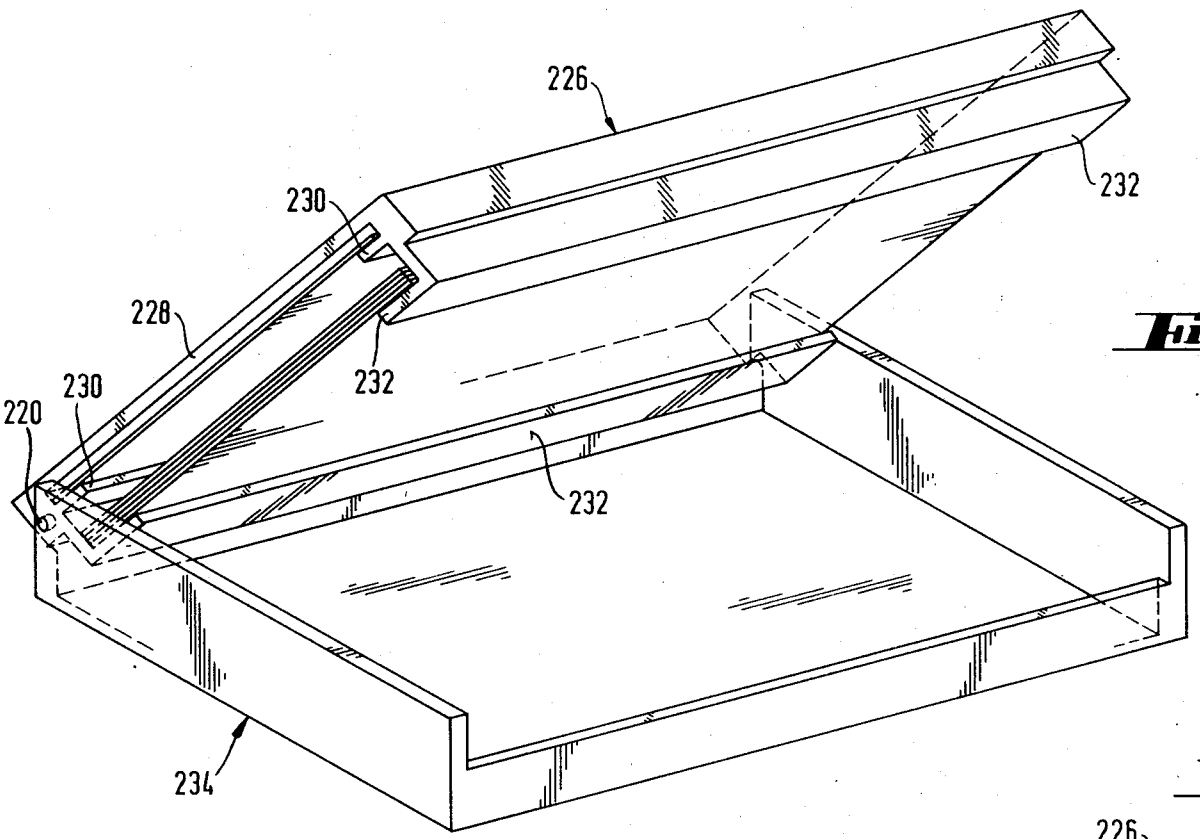
FIG. 12 is a view of a fifth preferred embodiment.
Figure 13:
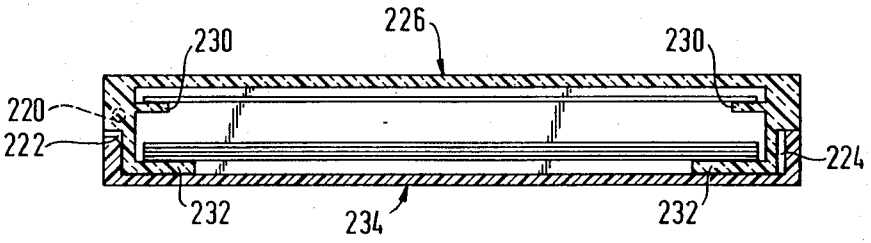
FIG. 13 is an end view, in section, of the fifth embodiment.

The fifth embodiment, shown in FIGS. 12 and 13, is very similar to the fourth embodiment except that in the fourth embodiment, members 204 and 212 fit together frictionally, whereas in the fifth embodiment, the corresponding members 226 and 234 are attached pivotally at one side at 220. Free spaces 222 and 224 permit the relative pivoting movement of members 226 and 234. Member 226 is integrally formed with and comprises window 228, separating elements 230, and clamps or shelves 232 which receive the stack of pictures. The second member 234 covers only the free edges of the pictures and their back. Pivot 220 is preferably formed by holes in either member 226 or 234 and pins formed integrally with the other member 226 or 234, the assembly taking place by means of elastic deformation of one or both members 226 or 234 so that the pins can snap into the holes.

Figure 14:
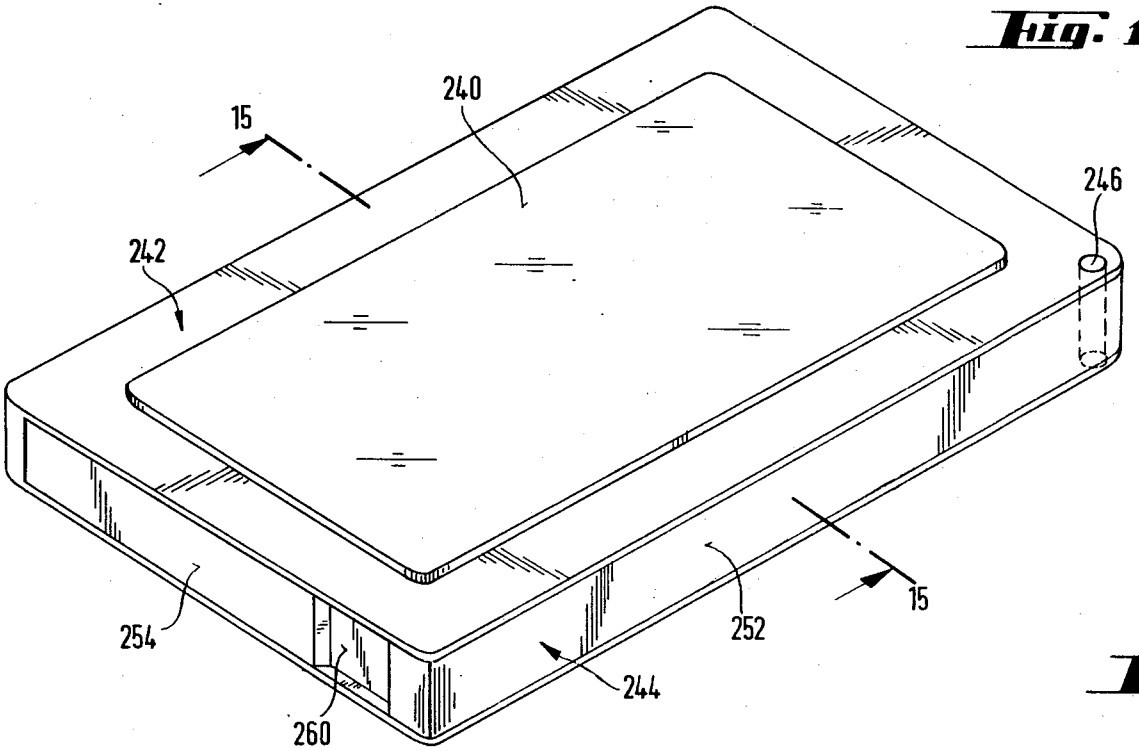
FIG. 14 is an isometric view of a sixth preferred embodiment.
Figure 15:
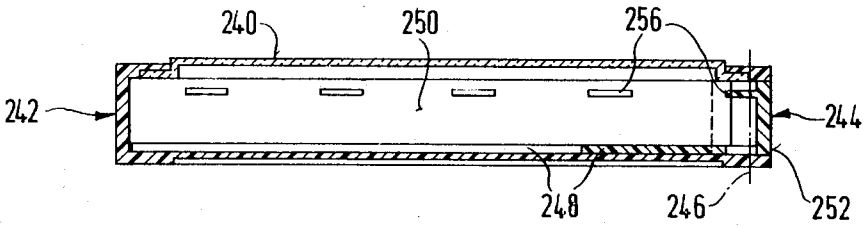
FIG. 15 is an end view of the sixth embodiment, taken from line 15—15 of FIG. 14.
Figure 16:
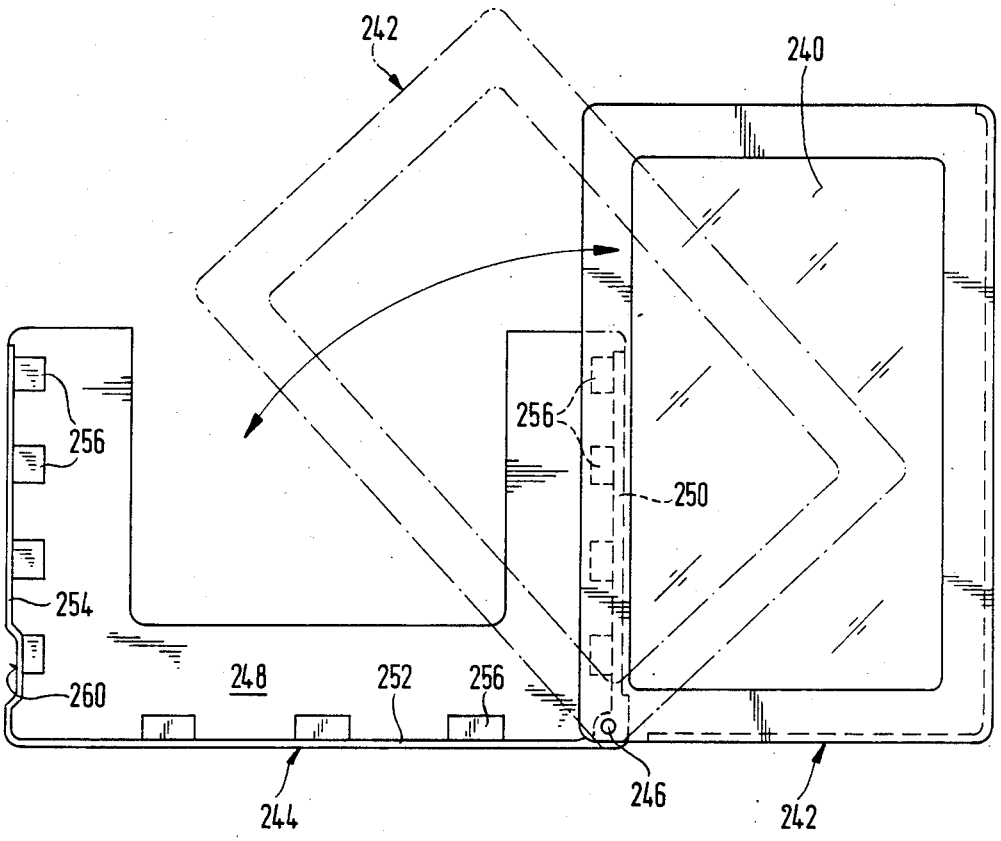
FIG. 16 is a front view of the sixth embodiment showing the pivoting relationship between two members thereof.

FIGS. 14–16 show a sixth embodiment, comprising a housing 242 having a display window 240, and an inner member 244. Inner member 244 has a U-shaped contour (FIG. 16) and a pivot connection with the housing 242. The pivoting movement occurs about a pin 246 at one corner of housing 242. The inner member 244 comprises a plate 248, which during pivoting slides along the housing wall opposite window 240, and orthogonally upstanding walls 250, 252, and 254. Extensions 256 on walls 250, 252, and 254 extend parallel to, and toward the center of, plate 248. Extensions 256 serve as separating elements between upper and lower chambers defined within members 242 and 244. A single picture may be accommodated between extensions 256 and the display window 240 of housing 242. The remaining stack fits into the space between extensions 256 and plate 248. An indentation 260 gives access for a finger tip to facilitate pivoting the inner member 244 outward to the position shown in FIG. 16.

The embodiments described above are containers comprising two members that are relatively movable either longitudinally or rotatably. It is possible to bias the members into either an open or a closed relative position by means of a spring and to lock them in the other of those two positions by a mechanism which can be manually disabled. Further, in all embodiments, it is possible, if desired, to present a picture at the window so that the picture is completely visible, i.e., with the picture's edges not covered. If, however, for esthetic reasons, a frame is desired around the display window, stop means should be provided within the container for aligning the picture with the window so that it cannot slip out of position in the display window.

In those embodiments where it has not been expressly mentioned, stand-up feet, and/or holes or eyes permitting the containers to be hung on a wall as a frame, can be provided. The foot or hole can be provided to place either the short or the long side of the picture on top.

Finally, in most of the described embodiments it is possible to provide a label at one front end of the container to identify the contents and to design the containers so that they can be stacked on each other when closed.

I claim:

1. A container for displaying a single picture and storing a stack of pictures, said container comprising means defining first and second chambers and having separating means common to and separating said first and second chambers, said first chamber being for retaining a single picture and said second chamber being for storing a stack of pictures, said first chamber having a display window opposite said separating means, and said separating means being for holding a single picture in position for display and being shaped to retain the single picture in position at said window, said container further comprising first and second members movable relative to each other, each of said members defining at least one wall of each of said chambers, said container being closed against removal of pictures from either of said chambers when said first and second members are in a first relative position and said first and second chambers being accessible for picture removal when said first and second members are in a second relative position.

2. A container as set forth in claim 1, wherein said separating means comprises a partition wall which substantially totally separates said two chambers from each other.

3. A container as set forth in claim 1, wherein said chambers have respective sidewalls and wherein said separating means comprises wall portions extending from said sidewalls of said chambers to form the first chamber.

4. A container as set forth in claim 1, wherein said first and second members are relatively pivotable.

5. A container as set forth in claim 1, wherein two members are longitudinally movable with respect to each other.

6. A container as set forth in claim 1, wherein one of said members is movable relative to the other of said members along a path defined by a combination of pivoting and longitudinal motions.

7. A container as set forth in claim 1, wherein, one of said members includes said display window and said separating means.

8. A container as set forth in claim 1, wherein, when said members are in said second relative position, after emptying said accessible chamber, the other of said chambers also becomes accessible for picture removal.

9. A container for displaying a single picture and storing a stack of pictures, said container comprising means defining first and second chambers and having separating means common to and separating said first and second chambers, said first chamber being for retaining a single picture and said second chamber being for storing a stack of pictures, said first chamber having a display window opposite said separating means, and said separating means being for holding a single picture in position for display and being shaped to retain the single picture in position at said window, said container further comprising first and second members movable relative to each other, each of said members defining at least one wall of each of said chambers, said container being closed against removal of pictures from either of said chambers when said first and second members are in a first relative position and at least one of said first and second chambers being accessible for picture removal when said first and second members are in a second relative position, said container further comprising switch means for selecting which of said chambers is accessible when said members are in said second relative position.

10. A container as set forth in claim 1, including a stand-up foot.

11. A container as set forth in claim 1, wherein one of said chambers is adapted to serve as a stand-up foot.

12. A container as set forth in claim 1, further having hang-up holes to permit use of said container as a wall frame.

13. A container as set forth in claim 1, further comprising spring means biasing said members into one of said two relative positions, and a manually releasable locking device for holding said members in the other of said relative positions.

14. A container for accommodation of a stack of pictures, said container comprising two substantially surface congruent chambers, separating means separating said chambers from each other, one of said chambers having, opposite said separating means, a display window for displaying a picture, said separating means serving for holding a picture flat against said display window, said one chamber being dimensioned between said separating means and said display window so that said one chamber can accommodate the thickness of exactly one picture, and said second chamber being for accommodating at least one picture, said container further comprising first and second members movable relative to each other, each of said members defining at least one wall of each of said chambers, said container being closed against removal of pictures from either of said chambers when said first and second members are in a first relative position and said first and second chambers being accessible for picture removal when said first and second members are in a second relative position.

* * * * *

UNITED STATES PATENT AND TRADEMARK OFFICE

CERTIFICATE OF CORRECTION

PATENT NO. : 4,691,456
DATED : September 8, 1987
INVENTOR(S) : Peter Ackeret

It is certified that error appears in the above-identified patent and that said Letters Patent is hereby corrected as shown below:

| Column | Line | |
|---|---|---|
| 1 | 39 | After "provide" insert --a--. |
| 2 | 14 | Change "an end" to --a sectional--. |
| 2 | 33 | Delete "113". |
| 2 | 37 | Delete "107". |
| 2 | 48 | Delete "113". |
| 2 | 49 | Delete "117". |
| 2 | 50 | Delete "117". |
| 2 | 62 | Delete "117". |
| 5 | 46 | After "pictures," insert --each of which may be as large as said single picture,--. |
| 5 | 58 | After "chambers" insert --and said separating means being permanently associated with at least one of said members--. |

UNITED STATES PATENT AND TRADEMARK OFFICE

CERTIFICATE OF CORRECTION

PATENT NO. : 4,691,456
DATED : September 8, 1987
INVENTOR(S) : Peter Ackeret

It is certified that error appears in the above-identified patent and that said Letters Patent is hereby corrected as shown below:

| Column | Line | |
|---|---|---|
| 5 | 64 | After "position" insert --and without disassociation of said separating means from said members--. |
| 6 | 42 | After "means" insert --operable when said first and second members are in said first relative position--. |
| 6 | 42 | After "which" insert --one--. |
| 6 | 68 | After "picture" insert --which may be as large as said picture in said one chamber--. |
| 7 | 3 | After "chambers" insert --and said separating means being permanently associated with at least one of said members--. |
| 8 | 4 | After "position" insert --and without disassociation of said separating means from said members--. |

Signed and Sealed this

Twenty-second Day of March, 1988

*Attest:*

DONALD J. QUIGG

*Attesting Officer*

*Commissioner of Patents and Trademarks*